United States Patent [19]

Bonne et al.

[11] Patent Number: 4,913,647

[45] Date of Patent: Apr. 3, 1990

[54] AIR FUEL RATIO CONTROL

[75] Inventors: Ulrich Bonne, Hopkins; Brian C. Krafthefer, Minneapolis, both of Minn.

[73] Assignee: Honeywell Inc., Minneapolis, Minn.

[21] Appl. No.: 841,488

[22] Filed: Mar. 19, 1986

[51] Int. Cl.[4] ..... F23N 5/00

[52] U.S. Cl. ..... 431/12; 431/76; 431/79

[58] Field of Search ..... 431/12, 76, 79; 236/15 E; 250/339; 340/578

[56] References Cited

U.S. PATENT DOCUMENTS

| | | | |
|---|---|---|---|
| 3,080,708 | 3/1963 | Carr | 431/79 X |
| 3,902,841 | 9/1975 | Horn . | |
| 4,039,844 | 8/1977 | MacDonald . | |
| 4,043,742 | 8/1977 | Egan et al. | 431/79 X |
| 4,059,385 | 11/1977 | Gulitz et al. . | |
| 4,370,557 | 1/1983 | Axmark et al. . | |
| 4,435,149 | 3/1984 | Astheimer . | |
| 4,455,487 | 6/1984 | Wendt . | |
| 4,463,260 | 7/1984 | Ikeda . | |
| 4,467,386 | 8/1984 | Wasson . | |
| 4,492,559 | 1/1985 | Pocock | 431/76 X |
| 4,516,929 | 5/1985 | Hirol et al. | 431/76 X |
| 4,565,788 | 1/1986 | Milovidov et al. | 431/76 X |

*Primary Examiner*—Randall L. Green

*Attorney, Agent, or Firm*—Omund R. Dahle

[57] ABSTRACT

A method and system for regulating and maintaining a predetermined desired fuel-air mixture for a fuel of interest as represented by a desired fuel number disclosed which utilizes a known relationship between the radiation intensity ratios of selected chemical species in the products of combustion and the fuel number as a basis to adjust the proportion of fuel within the fuel-air mixture to control at the desired fuel number.

19 Claims, 5 Drawing Sheets

VARIATION IN EMISSION INTENSITY WITH VARYING FUEL NUMBER FOR METHANE ($CH_4$) FUEL

VARIATION IN SIGNAL RATIO WITH VARYING FUEL NUMBER

SYSTEM CONTROL CYCLE

AIR FUEL RATIO CONTROL

BACKGROUND OF THE INVENTION

1. Field of the Invention

The present invention relates generally to the field of fuel-air mixture controls in flames and, more specifically, to a method for controlling burner efficiency by utilizing a control parameter based on a known relationship between the fuel number and emission radiation detected within the fuel flame.

2. Description of the Prior Art

Prior art has offered various optical methods to monitor and regulate the fuel-air mixture in burner flames. However, these methods either implement a complex control factor to allow for variable flame conditions or rely on simplifying assumptions which undermine the validity of the control parameter.

One such method and apparatus is described in U.S. Pat. No. 4,435,149. That system uses a type of radiation detection to derive a control parameter for fuel-air mixture in furnace flames which also compensates for variations in the flame path due to fluctuations in burning rate in an attempt to insure consistent monitoring of burner efficiency in a furnace having a variable firing or burning rate. Radiation detectors are used to sense carbon dioxide in the products of combustion. More particularly, wavelength bands are detected, namely, the strong and weak bands for carbon dioxide and a third band representing one of nonabsorption for any chemical species in the combustion products. The control ratio is derived from the strong $CO_2$ band and the nonabsorbing band emissions, while the weak $CO_2$ band emission is used to compensate for varying flame length due to varying load conditions.

However, this method has certain drawbacks. It is restricted to the use of $CO_2$ emission bands and, therefore, actually presents but another, more sophisticated, form of $CO_2$ emission radiation related controller which is common in the prior art. Furthermore, this method also assumes that particulate concentration within the flame is solely dependent on excess oxygen. It has been found, however, that this assumption fundamentally over-simplifies the parameter of particulate concentration under many circumstances, thereby imparting a shortcoming to the primary basis for calculating the control parameter. This, in turn, may lead to the introduction of serious error in results which, in this case, renders consistent monitoring of burner efficiency quite difficult.

On the other hand, the method of the present invention does not depend on such assumptions and accurately monitors burner efficiency regardless of fluctuating flame conditions and natural interferences thereby overcoming problems plaguing the prior art. The present method contemplates computation of a control parameter using any number of chemical species that emit radiation within the flame. The control parameter is based on the relationship between fuel number and the concentration of various chemical species within the flame. The relative intensity of radiation emitted by any given excited chemical species or emitter is indicative of concentration. The relative emission intensities of any two chemical species may be used to calculate the control parameter. This control parameter enables a burner to attain and maintain an optimum predetermined fuel number.

Unlike some prior methods, this method is not restricted to detection and control by monitoring a definite single species such as $CO_2$, provided the flame gases are optically thin in the spectral region being used. Any chemical species, occurring within the flame, as a combustion product of the burned fuel, can be used in the monitoring of flame efficiency. Furthermore, this control parameter does not require correction for fluctuating flame conditions. The persistent presence of quantum sufficient radiation eminating from the chemical combustion products allows accurate flame monitoring even with turbulent conditions, varying particle luminescense, varying flame shape, varying site, or varying burning rates. It is not insignificant that the underlying concept, that radiation intensity indicative of chemical species concentration correspondingly varies with fuel number, remains valid despite the presence of interferences. Finally, this method does not require any simplifying assumptions. The correlation between radiation intensity and fuel number is well documented. Thus, the present method provides positive monitoring and regulation of fuel number by a control parameter based on the relationship between fuel number and the intensity of radiation emitted from selected specific chemical species within the burner flame.

SUMMARY OF THE INVENTION

The method and system of the present invention facilitates accurate control of flame conditions by relating the change in fuel number to a corresponding variance in the concentration of specific chemical species and the resulting variance of emission radiation within the flame. Specific radiation within the flame is sensed and related to input signals used to derive a signal which is compared to a control signal. The difference in signals is then used to adjust the fuel concentration in the fuel-air mixture fed to the flame. The concentration of chemical species within the flame relates to the concentration of fuel in the fuel-air mixture. Changes in fuel concentration in the fuel-air mixture vary the concentration of chemical species in the flame, resulting in a corresponding change in the intensity of radiation emitted for such species. Accordingly, the result is either an increase or a decrease in the magnitude of the signals which are ultimately used to compute the control ratio.

In the preferred embodiment narrow band optical radiation from at least two chemical species is detected within the flame. The intensity of the radiation from each such species detected is converted into a signal. Signal magnitudes of two separate chemical species present within the flame are used to compute a derived signal ratio. This derived signal ratio varies with a corresponding variance in fuel number. The derived signal ratio is then compared to a previously determined signal ratio representing the desired fuel number which is the fuel-air mixture at which the burner operator has chosen to maintain flame burner. The apparent difference in the magnitude of the two signal ratios is correspondingly related to a proportional adjustment of fuel within the fuel-air mixture burned in the flame. The flame is again monitored to determine whether the desired fuel number has been attained. If the desired fuel number has not been attained, the system reinitiates the control cycle. Once the desired fuel number has been attained, the system reinitiates the control cycle after a given period of time based on a timing device. The timing device can also be used to enable monitoring of multiple flames by cyclicly initiating a control cycle, in turn, for each flame. The continuous monitoring of chemiluminescent radiation from the flame allows for the initial attainment of desired flame efficiency as well as the continuous maintenance of desired flame conditions.

BRIEF DESCRIPTION OF THE DRAWINGS

In the drawings wherein like numerals are utilized to depict like parts throughout the same.

DESCRIPTION OF THE PREFERRED EMBODIMENT

Figure 1A:
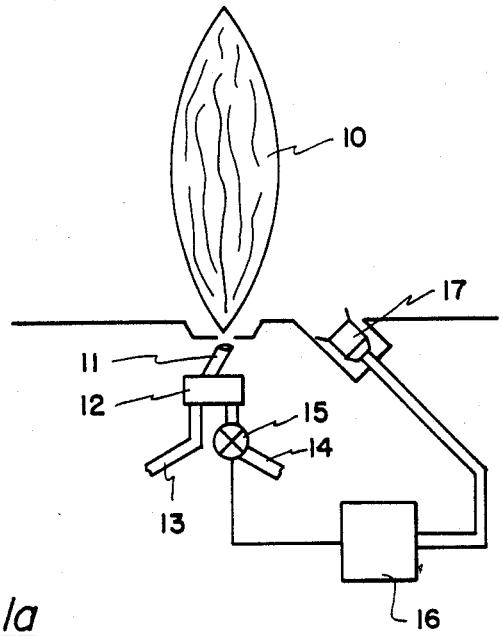
FIG. 1*a* is a view partially in section of a typical single flame burner employing the invention method.

FIG. 1*a* depicts a typical burner equipped with the fuel-air ratio control method of this invention. The burner flame 10 rides directly over a fuel-air tube 11 which supplies the flame with a fuel-air mixture blended within a mixing apparatus 12. The mixing apparatus 12 is fed by an air injection tube 13 which introduces air into the mixing apparatus at a constant rate and a fuel injection tube 14 which introduces fuel at a rate regulated by an adjustable fuel flow valve 15. The fuel flow valve 15 regulates fuel volume in the mixing apparatus 12 and is controlled as by an electric signal generated by a system signal processor 16.

The system signal processor 16 receives signals from the array of photodetectors 17 monitoring emission radiation within the flame 10. The photodetector array 17 houses at least two photodiodes each of which is spectrally filtered to receive emission radiation from a respective prechosen chemical species. For ease in application and use the array 17 is comprised of at least two diodes and, more likely four diodes, which can be separately selectively filtered by interchangeable filter devices (not shown) in a well-known manner. This provides the operator with a great number of potential chemical species to monitor the flame. Using the output signals from the photodiodes of the photodetector array 17 the system signal processor 16 computes a control signal for regulating burning conditions in accordance with the method detailed below.

Figure 1B:
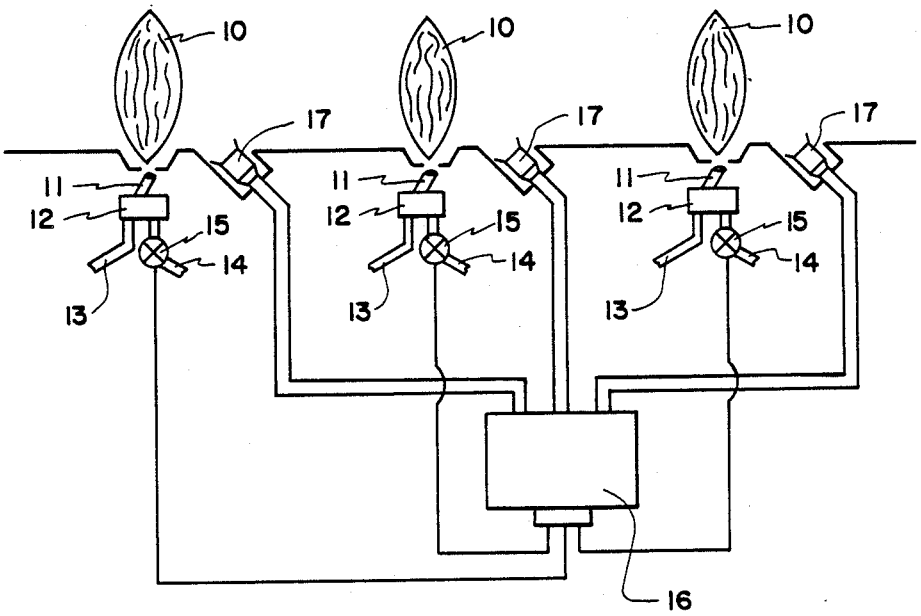
FIG. 1*b* is a view partially in section of a typical multi-flame burner arrangement employing the invention method.
Figure 4:
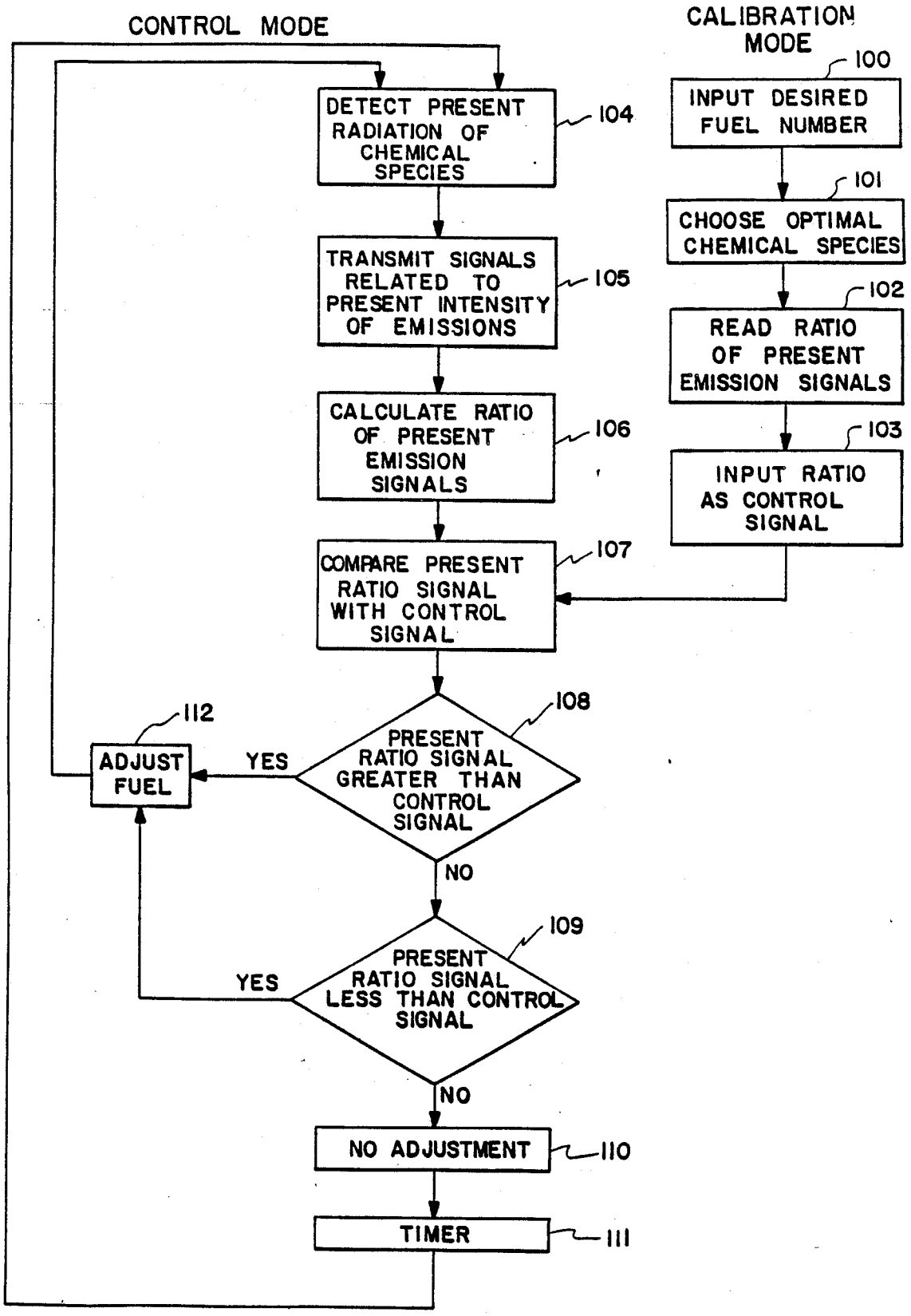
FIG. 4 is a logic diagram for the task of deriving the control parameter described in this invention and maintaining a desired fuel number and FIG. 5 is a logic diagram for determining the system control species for use in the control logic of FIG. 4.

FIG. 1*b* is a view similar to FIG. 1*a* of a typical multiple flame burner equipped with the fuel-air ratio control of this invention. The primary distinction is in the complexity of the system signal processor 16. Instead of regulating a single flame, the system signal processor 16 in a multiple flame configuration, FIG. 1*b*, has to step-and-repeat the monitoring process in order to properly regulate each flame burner. This process is completed through operation of the timer and will become obvious as FIG. 4 is explained. However, as is apparent from FIG. 1*b*, each flame can be seperately monitored to prevent appreciable variance in flame conditions on a flame-by-flame basis. This method allows adjustment of each flame, on a flame-by-flame basis, to equal burning conditions. This function represents a distinct step forward from prior art which could monitor multiburner systems only through cumulative analysis of flame conditions or flame gases.

Figure 2:
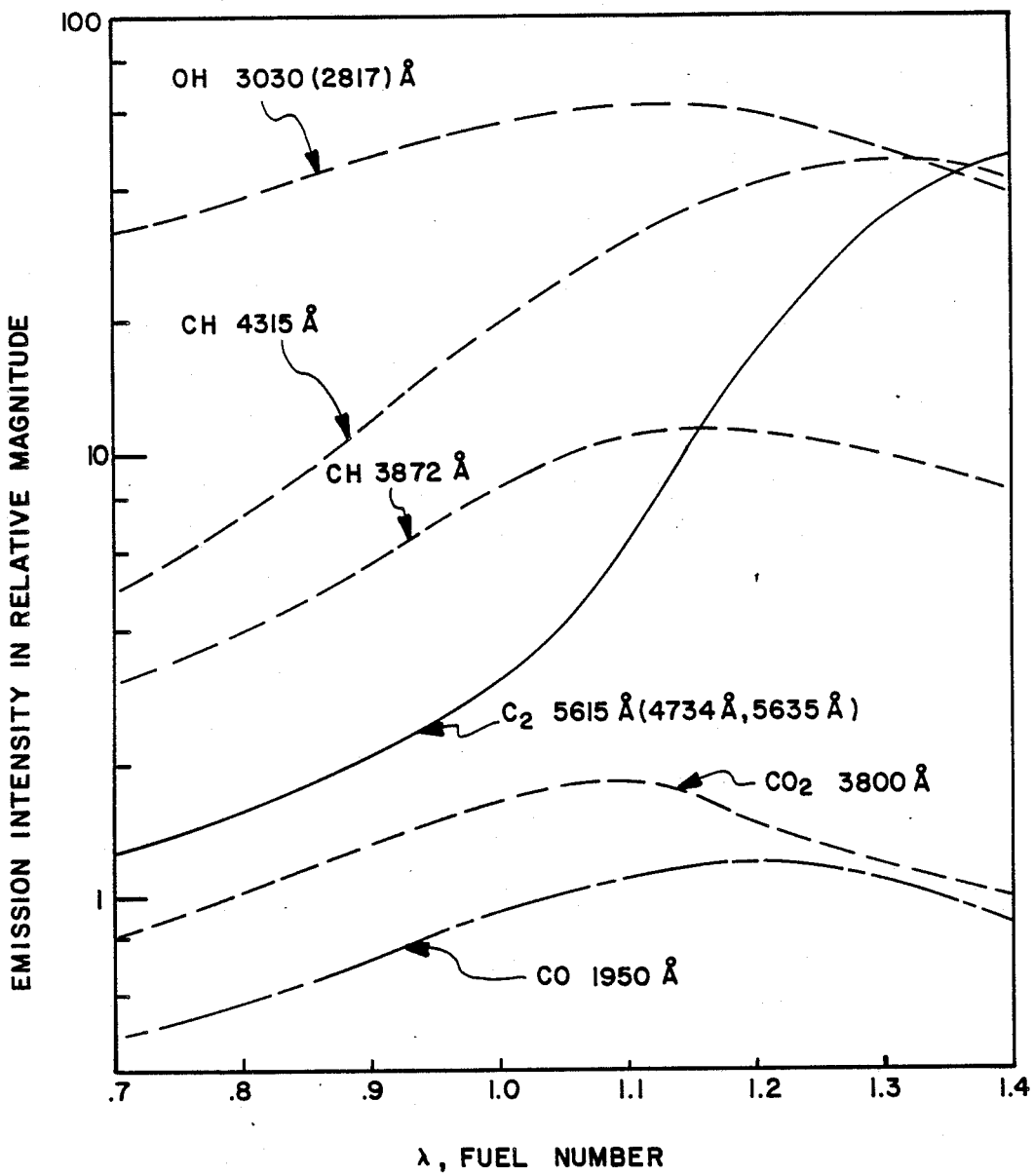
FIG. 2 is a graph representing the emission intensity output signals versus fuel number for a variety of chemical species typically found as combustion products of methane fuel burned within the flame.

FIG. 2 is a graph of emission intensity for chemical species typically found in a flame burning methane fuel versus variation in fuel number λ. Emission intensity for any specific chemical species within a flame is dictated by the concentration of fuel and air being burned within the flame. As the fuel concentration changes, the atomic ratio of carbon/oxygen and oxygen/hydrogen changes in the flames. Furthermore, change in fuel concentration results in the molecular composition of the flame and fuel gases changing along with the relative frequency of reactions that produce chemical intermediates such as CO, CH, OH, H and $C_2$. Chemical reactions within the flame result in spectral emissions at highly specific wavelengths. Changing the fuel concentration in the flame alters the intensity of these spectral emissions by altering the number of chemical reactions within the flame. This relationship is disclosed in FIG. 2, where with a variance of fuel number roughly representing fuel concentration within the flame, spectral emission intensity also varies.

Specifically, fuel number (λ) is a parameter known in the art and representative of the following equation:

$$\lambda = \frac{(\%\ \text{fuel}/\%\ \text{air})_{ACTUAL}}{(\%\ \text{fuel}/\%\ \text{air})_{STOICHIOMETRIC}} \quad (1)$$

The numerator of the ratio represents current flame conditions and is itself a ratio of fuel to air as combined in the mixing apparatus 12 and burned in the flame 10. The denominator of the fuel number ratio represents the ideal molar ratio of fuel to air for a stoichiometric burning of fuel and oxygen which for hydrocarbons is in accordance with the following equation:

$$CH_B + \left(1 + \frac{B}{A}\right)O_2 \rightarrow CO_2 + \frac{B}{2}H_2O \quad (2)$$

Figure 3:
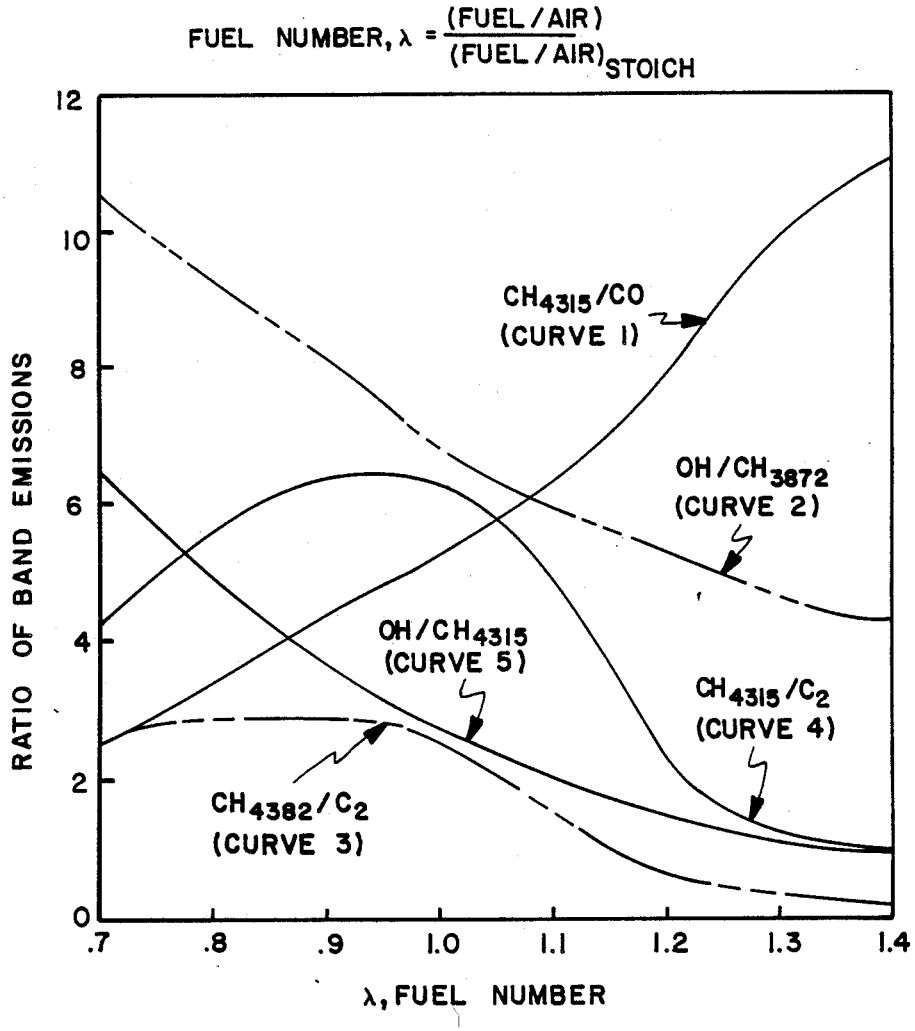
FIG. 3 is a graph depicting certain ratios of emission output signals versus fuel number for a variety of chemical species typically found as combustion products of methane fuel burned within the flame.

This is explained by example through FIGS. 2 and 3 using methane ($CH_4$) as the fuel of choice. Equation written for methane is:

$$(CH_4) + 2(O_2) \rightarrow (CO_2) + 2(H_2O) \quad (3)$$

The ratio of fuel to oxygen is 1 to 2. Thus, the denominator of the fuel number ratio is $0.5 \times 3.76$.

The utility and benefit of the fuel number denominator is that it normalizes fuel-air mixture for any specific fuel around $\lambda = 1$. If $\lambda < 1$, then the flame system is burning fuel rich. If $\lambda > 1$, then the flame system is burning oxygen rich. Thus, properly calculated, the fuel number will provide a parameter which instantly identifies fuel-air mixture with regard to the fuel of choice burning in the flame.

Thus, FIG. 2 shows the relative intensity of spectral emissions from various chemical species as the flame varies from an $O_2$ rich, fuel-air mixture to a fuel rich fuel-air mixture. This relationship between emission intensity and λ is fundamental to the control method and is not subject to flame burning rate, particle luminescence, or flame turbulence.

FIG. 3 is a graphical representation of plurality ratios of two distinct emission signals, obtained from FIG. 2, versus fuel number, showing how this ratio will vary from an $O_2$ rich flame to a fuel rich flame. Chemical species control ratios should be chosen to provide a curve where each fuel number over a range of potential fuel numbers (x-axis) is represented by a distinct ratio value (y-axis) representative of the emission radiation ratio of the two chosen chemical species. For example, in FIG. 3 there are five curves representing the relationship between fuel number and emission ratio for two given chemical species. Curves 1 and 2 provide an excellent means of analyzing fuel number for two reasons. First, both curves 1 and 2 have a slope which ensures a distinct identification of fuel number by emission ratio. Second, neither curves 1 or 2 encompass a maximum or plateau section where different fuel numbers exhibit the same emission ratio value as is the case with curves 3 and 4.

Curve 3 plateaus between fuel numbers 0.7 and 1.0 and offers only a slight gradient between fuel numbers 1.0 and 1.4. As a result, the same emission ratio value would identify all the fuel numbers between 0.7 and 1.0 and fuel numbers 1.0 to 1.4 would be identified and distinguish by marginal distinctions in emission ratio value. Curve 4 offers a peak at fuel number 0.95. Thus, emission ratio values between 4.25 and 6.75 identify at least two fuel numbers within the range of 0.7 to 1.1. Hypothetically, as will be seen in subsequent steps, if the desired fuel number was 0.95 and the present fuel number fell within the range of 0.7 to 1.1, the system would not know whether to increase or decrease the concentration of fuel flowing to the mixing apparatus 17, FIG. 1*a*.

Aside from a reduced gradient, curve 5 parallels mirrors curve 2 presenting advantages superior to curves 3 and 4 but subordinate to curves 1 and 2. Finally, equipping the sensor array with more than two sensors at one time will allow a more expeditous means of choosing the appropriate chemical species. The variation in emission signals, FIG. 3, can be analyzed for a variety of chemical species simultaneously for the entire range of potential fuel numbers.

FIG. 4 depicts the logic diagram for the system control cycle that attains and maintains the desired fuel number. The system control cycle has two modes; the first mode being for calibration (100–103), and the second mode being for control of flame conditions (104–112).

Prior to controlling flame conditions, the system control cycle must be calibrated. This is done by inputting the desired fuel number 100 into the system signal processor. Then by using a graph similar to that shown in FIG. 2 and in light of the forgone analysis of optimal chemical species, the system controller chooses two chemical species which will result in a curve which will serve to identify specific fuel number values at any given point, 101. Using these two chemical species the system signal processor then converts the desired fuel number into a ratio of present emission signals 102 by reading a graph similar to FIG. 3, that generated for methane. The ratio of present emission signals is the numerical value representative of the intensity of radiation emitted from the first chemical constituent over the numerical value representative of the intensity of the radiation emitted from the second chemical constituent. Either chemical species may be placed in the numerator or the denominator of the ratio. However, once the numerator and denominator are chosen, the ratio must retain the same form throughout the process. The system signal processor then inputs this ratio signal as the control signal into the control mode of the system control cycle 103. The calibration mode is now ended. FIGS. 2 and 3 of this invention merely represent exemplary data for methane fuel. From the preceding analysis of the two figures as well as the explanation of fuel number, it is readily seen how one would obtain analogous data for other fuels. This method is intended to apply to any flame burning fuels which exhibit analogous relationships to those shown in FIGS. 2 and 3.

Figure 5:
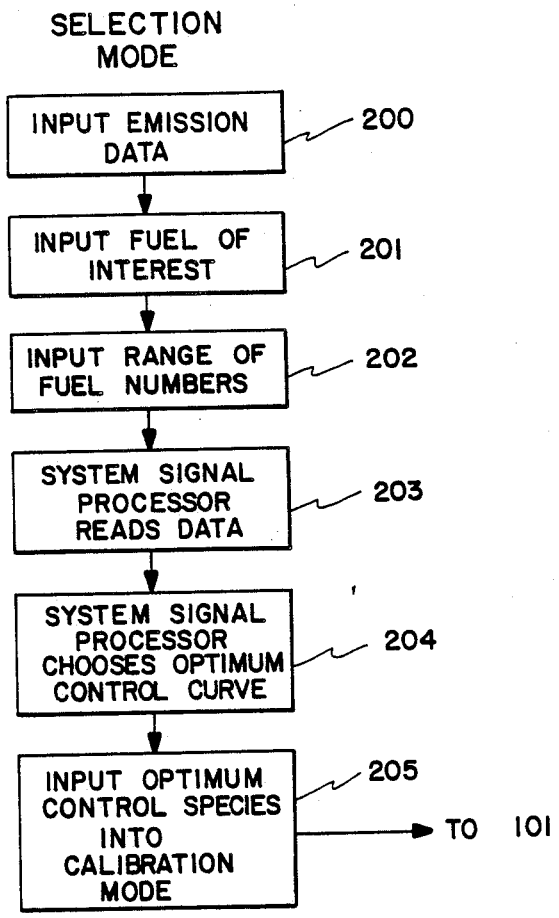

In an alternative embodiment of the system control cycle, FIG. 4, the calibration mode is preceded by a selection mode, FIG. 5. In the selection mode emission data on chemical combustion products found in the flame, similar to that found in FIG. 3 for methane, is read into the system signal processor 200 for all potential fuels of interest. The operator then inputs the fuel of interest, 201 being that fuel which is to be burned in the flame. Then the potential range of fuel numbers across which the flame conditions may vary are input into the system signal processor, 202. The system signal processor then reads the emission data for the specific fuel of interest previously chosen concentrating on the region within the range of potential fuel numbers previously indicated, 203. Then the system signal processor chooses the optimum control curve 204 much the same way as an optimum control curve is chosen manually in FIG. 3. The system signal processor will determine which curve has the greatest negative or positive slope within the range of possible fuel numbers. Curves which represent two fuel numbers by the same band emission ratio value, similar to curve 4 in FIG. 3 between $\lambda=0.7$ and $\lambda=1.1$, within the range of possible fuel numbers will automatically be omitted from the selection. Once the optimal chemical species are chosen they are input 205 into the calibration mode at step 101, FIG. 4. This is normally the step at which the optimal chemical species are chosen manually.

The control mode of the system control cycle is shown in steps 104 to 112 of FIG. 4. Periodically, on a repeating basis, emission radiation from the two respective chemical species, prechosen under 101 of the calibration mode, is detected at 104 controlled by on the timer 111. At 105 the intensity of this radiation is measured and a signal proportionate to the intensity is transmitted to a microprocessor or similar device. It should be noted that the system control cycle, including the calibration mode can be used with a digital or analog signal system. A ratio, 106, is then calculated from the relative emission input signals received from 105. This ratio is of the same form as that derived under 102 in the calibration mode.

The sensed ratio signal 106 is then compared with the control ratio signal (103) at 107. If the sensed ratio signal is greater than the control signal at 108, then the amount of fuel flowing to the flame is adjusted in the appropriate direction, i.e., increased or decreased at 114. The magnitude of the fuel adjustment is proportional to the difference between the control signal and sensed signal. The system then reinitiates steps 104 to 108 of the control cycle.

If the sensed ratio signal is not greater than the control signal, then the system signal processor 16, FIG. 1*a*, asks whether the sensed ratio signal is less than the control signal at 109. If the sensed ratio signal is less than the control signal, then the fuel is adjusted in the appropriate direction as above at 112. If the sensed ratio signal is not less than, i.e. equal to, the control signal then no fuel adjustment is made as at 110. The system then waits for a timer 111, to reinitiate the control cycle after a preselected period.

For multi-burner systems where each flame is monitored independently, as shown in FIG. 1*b*, the timer will respond at the end of the first cycle by stepping to the next flame burner and repeating the control cycle. This step-and-repeat function allows one system signal processor to control a plurality of burners through the use of independent detector mechanisms. The system signal processor will continue to control each flame in turn by detecting the same chemical species and applying the same control signal. Of course, a single detector array could also be used to control a plurality of similarly situated flames.

In adjusting the fuel flow 114 to the mixing apparatus 12, the system signal processor 16 will initiate an increase or decrease in fuel flow depending on whether the curve, representative of fuel number versus emission ratio of the prechosen chemical species, FIG. 3, has a negative or positive slope. For example, curve 1 in FIG. 3 has a positive slope while curve 2 has a negative slope. If the curve has a positive slope, as with curve 1, a sensed ratio signal greater than the control signal will require an adjustment reducing fuel flow. If the control signal is less than the present ratio signal, an adjustment increasing fuel flow will be required. Conversely, if the curve has a negative slope as with curve 2, the fuel number equation will require fuel adjustments in the reverse direction. The proper responses are summarized:

| Slope of Curve (100–105) | Relative Value of Control Parameters (109–111) | Fuel Concentration Adjustment (114) |
|---|---|---|
| positive: | control signal (>) sensed ratio signal | increase fuel |
| | control signal (<) sensed ratio signal | decrease fuel |
| negative: | control signal (<) sensed ratio signal | decrease fuel |
| | control signal (>) sensed ratio signal | increase fuel |

As can be seen in FIG. 4, the control cycle will be continually reinitiated until the sensed ratio signal equals the control signal at which time no adjustment in fuel concentration is required at which point the system will be controlled by the timer 111. Of course, a change in fuel type will require the repetition of the process steps 100 to 103. Likewise, a change in the choice of chemical species to monitor will also require such repetition.

As can be seen from the foregoing, the control system of the invention has the ability to regulate any flame that uses a fuel which provides radiation-emitting chemical species as combustion products. It is both simple and quite versatile and can take many alternative forms and applications. The examples provided herein are considered for purposes of illustration and are not intended to limit the scope or spirit of the invention.

The embodiments of the invention in which an exclusive property or right is claimed are defined as follows:

1. A method for regulating and maintaining a predetermined desired fuel-air mixture for a fuel of interest over a substantially full combustion range as represented by a desired fuel number comprising the steps of:

a. sensing the presence of at least two chemical species of interest in the products of combustion of said fuel at least one of which contains oxygen;

b. generating input signals related to the concentration of each of said chemical species of interest;

c. deriving a sensed ratio signal by obtaining the ratio of a selected two of said input signals wherein at least one of said selected two input signals is based on an oxygen-containing species of interest, said ratio having a known relationship to the existing fuel number of the fuel of interest;

d. providing a control signal based on a known relationship between the desired fuel number and the particular ratio of the selected two chemical species of said input signals;

e. comparing the sensed present ratio signal with the control signal;

f. adjusting the proportion of fuel and air in said mixture based on the comparison of said sensed present ratio signal and said control signal until said sensed present ratio signal substantially equals said control signal.

2. The method of claim 1 wherein said selected two chemical species of said control signal are determined by the steps of:

a. picking the fuel of interest;

b. selecting a potential fuel number range;

c. defining the two chemical species which produce the optimum ratio signal variation for said fuel of interest within said fuel number range by evaluating known emission data for all potential chemical species of interest with respect to the bounds of said fuel number range.

3. The method of claim 2 wherein the determination of the said selected two chemical species is based on the known relationship of predetermined pairs of said chemical species of interest, said selected two chemical species comprising one such pair.

4. The method of claim 2 wherein said chemical species of interest are selected from the group consisting of OH, C—H, $C_2$, CO, and $CO_2$.

5. The method of claim 1 wherein the determination of the said selected two chemical species is based on the known relationship of predetermined pairs of said chemical species of interest, said selected two chemical species comprising one such pair.

6. The method of claim 5 wherein said predetermined pair of said selected chemical species is one selected from the group consisting of C—H and CO and OH and CH.

7. The method set forth in claim 1 where a plurality of flames are controlled.

8. The method of claim 7 wherein said predetermined pair of said selected chemical species is one selected from the group consisting of C—H and CO and OH and CH.

9. The method of claim 1 wherein said chemical species of interest are selected from the group consisting of OH, C—H, $C_2$, CO, and $CO_2$.

10. The method of claim 1 wherein said fuel is one selected from the group consisting of hydrocarbons, fossil fuels, fluorocarbons, and sulphated fuels.

11. The method set forth in claim 10 where the fuel of interest is $CH_4$.

12. The method set forth in claim 10 where the fuel of interest is pulverized coal.

13. The method set forth in claim 1 wherein the presence of more than two chemical species within the flame is detected.

14. The method set forth in claim 1 where said input signals related to the concentration of each chemical species are electrical signals.

15. A essentially full-range system for regulating and maintaining a predetermined desired fuel-air mixture for the combustion of a fuel of interest as represented by a desired fuel number comprising:

a. sensing means for sensing the presence of at least two chemical species of interest, at least one of which contains oxygen, in the products of combustion of said fuel;

b. signal generating means for generating input signals related to the concentration of each of said plurality of chemical species of interest; said signal generating means further comprising means for deriving a sensed ratio signal of a selected two of said input signals at least one of which is derived from a species of interest which contains oxygen said ratio having a known relationship to the existing fuel number of the fuel of interest;

c. means for providing a control signal based on a known relationship between the desired fuel number and the particular ratio of the selected two chemical species said input signals;

d. means for comparing the sensed ratio signal with the control signal; and e. control means for adjusting the proportion of fuel and air in said mixture based on the comparison of said sensed ratio signal and said control signal until said sensed present ratio signal substantially equals said control signal.

16. The system of claim 15 further comprising determining means for fixing upon said selected two chemical species of said control signal said determining means further comprising:

a. means for picking the fuel of interest;

b. means for selecting a control fuel number within a fuel number range;

c. means for defining the two chemical species which produce the optimum ratio signal variation for said fuel of interest within said fuel number range for evaluating known emission data for all potential chemical species of interest with respect to said fuel number range.

17. The system of claim 16 wherein said means for defining said selected two chemical species further comprises means for basing said selection on the known relationship of predetermined pairs of said chemical species of interest, said selected two chemical species comprising one such pair.

18. The system of claim 15 wherein said sensing means comprises a photodiode array.

19. The system of claim 15 wherein a plurality of flames are controlled.

* * * * *